US006543068B1

(12) United States Patent
Penninger

(10) Patent No.: US 6,543,068 B1
(45) Date of Patent: Apr. 8, 2003

(54) HOME HEALTH CARE BED BATH

(76) Inventor: Alisa Penninger, 11334 Johnson-Davis Rd., Huntersville, NC (US) 28078

( * ) Notice: Subject to any disclaimer, the term of this patent is extended or adjusted under 35 U.S.C. 154(b) by 0 days.

(21) Appl. No.: 10/105,859

(22) Filed: Mar. 25, 2002

(51) Int. Cl.[7] ..... A47K 3/06
(52) U.S. Cl. ..... 4/585; 5/606; 5/928
(58) Field of Search ..... 4/585–588; 5/606, 5/928

(56) References Cited

U.S. PATENT DOCUMENTS

| | | | | | |
|---|---|---|---|---|---|
| 2,471,302 | A | * | 5/1949 | Boward | 4/588 |
| 3,409,917 | A | * | 11/1968 | Howard | 4/588 |
| 3,681,789 | A | * | 8/1972 | Bott | 4/588 |
| 4,068,326 | A | * | 1/1978 | Deschler | 4/588 |
| 4,177,807 | A | * | 12/1979 | Ocel et al. | |
| 4,613,997 | A | * | 9/1986 | Langdale | |
| 4,935,971 | A | * | 6/1990 | Dunn et al. | 4/585 |
| 4,964,183 | A | * | 10/1990 | LaForce, Jr. | 4/585 |
| 5,025,515 | A | * | 6/1991 | Rhines | 4/585 |
| 5,247,712 | A | * | 9/1993 | Williams | 4/585 |
| 5,341,526 | A | * | 8/1994 | Kennedy | 4/585 |
| 6,088,848 | A | * | 7/2000 | Waterlyn | 4/585 |
| 6,266,830 | B1 | * | 7/2001 | Danno et al. | 4/585 |

* cited by examiner

*Primary Examiner*—Charles R. Eloshway
(74) *Attorney, Agent, or Firm*—Michael I. Kroll

(57) ABSTRACT

Disclosed is a portable bed-bath and shower device. The device provides an oblong, inflatable bath tub unit 12 used to assist in the bathing of bed ridden patients. The bath tub or housing 12 of the device is a rubber material consisting of an electric air compressor 20, water valve 22, dirty water discharge pump 24 and hose 26, shower head 28, hook and loop straps 18, a swivel head hanger 46, storage pockets 30 for soap and wash cloths and tote cart 70. A patient can be easily placed upon the bath unit prior to the inflation thereof. The bath unit is then inflated by the electric compressor 20 and a hose 44 is connected to the water valve of the unit and at the other distal end, to a sink. Hook and loop fasteners 18 are supplied to secure the patient 14 within the bath device and to lift the limbs of a patient for easy cleaning of the limbs. A water valve 22 is also provided consisting of a control valve 38 and separate drain valve 40. A dirty water discharge pump 24 and hose 26 are supplied to empty used, dirty water from the interior of the tub 12. When the device is not in use, it may be stored away by hanging from the provided hanger unit 46 or stored within the provided tote cart 70.

7 Claims, 12 Drawing Sheets

HOME HEALTH CARE BED BATH

BACKGROUND OF THE INVENTION

FIELD OF THE INVENTION

The present invention relates generally to Health care baths and more specifically, to a home and hospital Health care, portable bed-bath and shower device. The device of the present invention provides an inflatable bath and tub, used to assist in the bathing of bed ridden patients. The housing of the device is a rubber material consisting of an electric air compressor, water valve, dirty water discharge pump and hose, shower head, hook and loop straps, a swivel head hanger, storage pockets for soap and wash cloths and tote cart. A patient can be easily placed upon the bath unit in a respective position prior to the inflation of the bed. The bath unit is then inflated by the electric compressor and a hose is connected to the water valve of the unit and at the other distal end, to a sink. A bath may now proceed. Hook and loop fasteners are supplied to secure the patient within the bath device and to lift the limbs of a patient for easy cleaning of the limbs. The electric air compressor unit consists of an air release valve. A water valve is also provided consisting of a control valve and separate drain valve. The shower head portion of the device has an on/off trigger to regulate water flow as required. A dirty water discharge pump and hose are supplied to empty used dirty water from the interior of the tub. Inflated ridges located at the lower surface of the interior portion of the device aid in proper water circulation and provides additional comfort to the patient.

When the device of the present invention is not in use, it may be stored away by hanging from the provided hanger unit or stored within the provided tote cart.

SUMMARY OF THE PRESENT INVENTION

The present invention discloses a portable bed-bath and shower device. The device of the present invention provides an oblong, inflatable bath tub unit used to assist in the bathing of bed ridden patients. The bathtub or housing of the device is a rubber material consisting of an electric air compressor, water valve, dirty water discharge pump and hose, shower head, hook and loop straps, a swivel head hanger, storage pockets for soap and wash cloths and tote cart. A patient can be easily placed upon the bath unit prior to the inflation thereof. The bath unit is then inflated by the electric compressor and a hose is connected to the water valve of the unit and at the other distal end, to a sink. A bath may now proceed. Hook and loop fasteners are supplied to secure the patient within the bath device and to lift the limbs of a patient for easy cleaning of the limbs. A water valve is also provided consisting of a control valve and separate drain valve. A dirty water discharge pump and hose are supplied to empty used, dirty water from the interior of the tub. Inflated ridges located at the lower surface of the interior portion of the device aid in proper water circulation and provides additional comfort to the patient. When the device of the present invention is not in use, it may be stored away by hanging from the provided hanger unit or stored within the provided tote cart.

A primary object of the present invention is to provide a home and hospital Health care, portable bed-bath and shower device.

Another object of the present invention is to provide a home and hospital Health care, portable bed-bath and shower device that is inflatable.

Yet another object of the present invention is to provide a home and hospital Health care, portable bed-bath and shower device that is inflatable and used to assist in the bathing of bed ridden patients.

Still yet another object of the present invention is to provide a home and hospital Health care, portable bed-bath and shower device that has a rubber housing consisting of an electric air compressor, water valve, dirty water discharge pump and hose, shower head, hook and loop straps, swivel head hanger, storage pockets and tote cart.

Yet another object of the present invention is to provide a home and hospital Health care, portable bed-bath and shower device that is inflated by an electric compressor.

Additional objects of the present invention will appear as the description proceeds.

The present invention overcomes the shortcomings of the prior art by providing a home and hospital Health care, portable bed-bath and shower device that provides a tote cart that consists of a mesh bag that is removable and washable, has storage bags for hoses and other accessories and a frame of light weight material and is easily stored.

The foregoing and other objects and advantages will appear from the description to follow. In the description reference to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claim.

LIST OF REFERENCE NUMERALS

Figure 1:
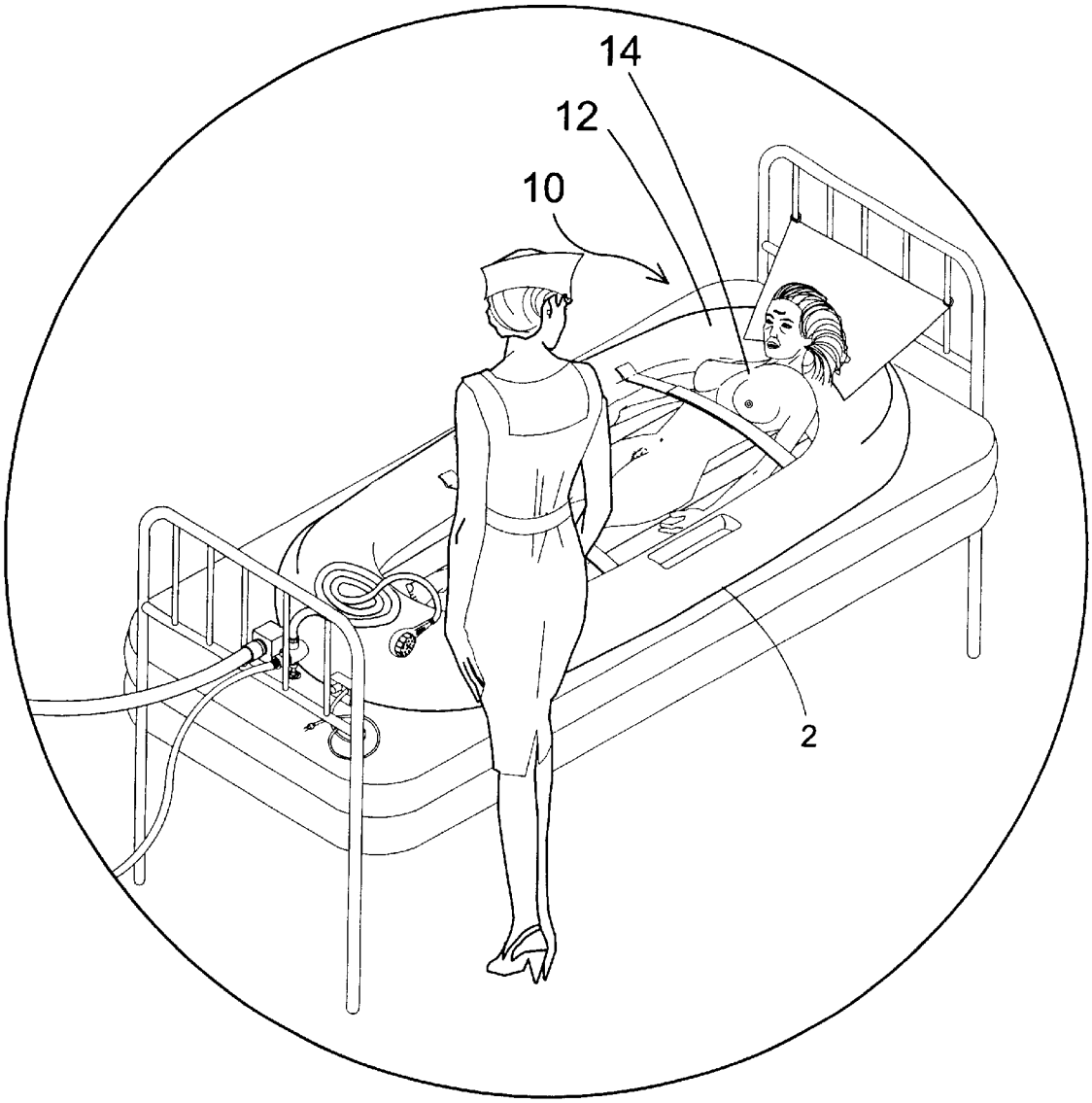
FIG. 1 is an illustrative view of the present invention in use.

With regard to reference numerals used, the following numbering is used throughout the drawings.

10 present invention

12 bath tub

14 patient

16 bed

18 hook and loop straps
20 air compressor
22 water valve
24 discharge pump
26 hose
28 shower head
30 storage pockets
32 hair wash funnel
34 adjustable straps
36 air release valve
38 control valve
40 drain valve
42 discharge hose
44 inlet hose
46 swivel hanger
48 inflated ridges
50 bottom of bath
52 air filled cavity
54 inlet hose connection
56 shower hose connection
58 water valve attachment cap
60 air release switch
62 motor
64 power cord
66 drain port
68 flap
70 tote cart
72 mesh bag
74 storage bags
76 frame
78 wheels
80 legs
82 handle
84 cover
86 hook and loop material
88 body lift member

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention, a home and hospital health care portable bed-bath and shower device is provided. The device is an inflatable bath tub 12 and is used to assist in the bathing of bed ridden patients 14.

Figure 2:
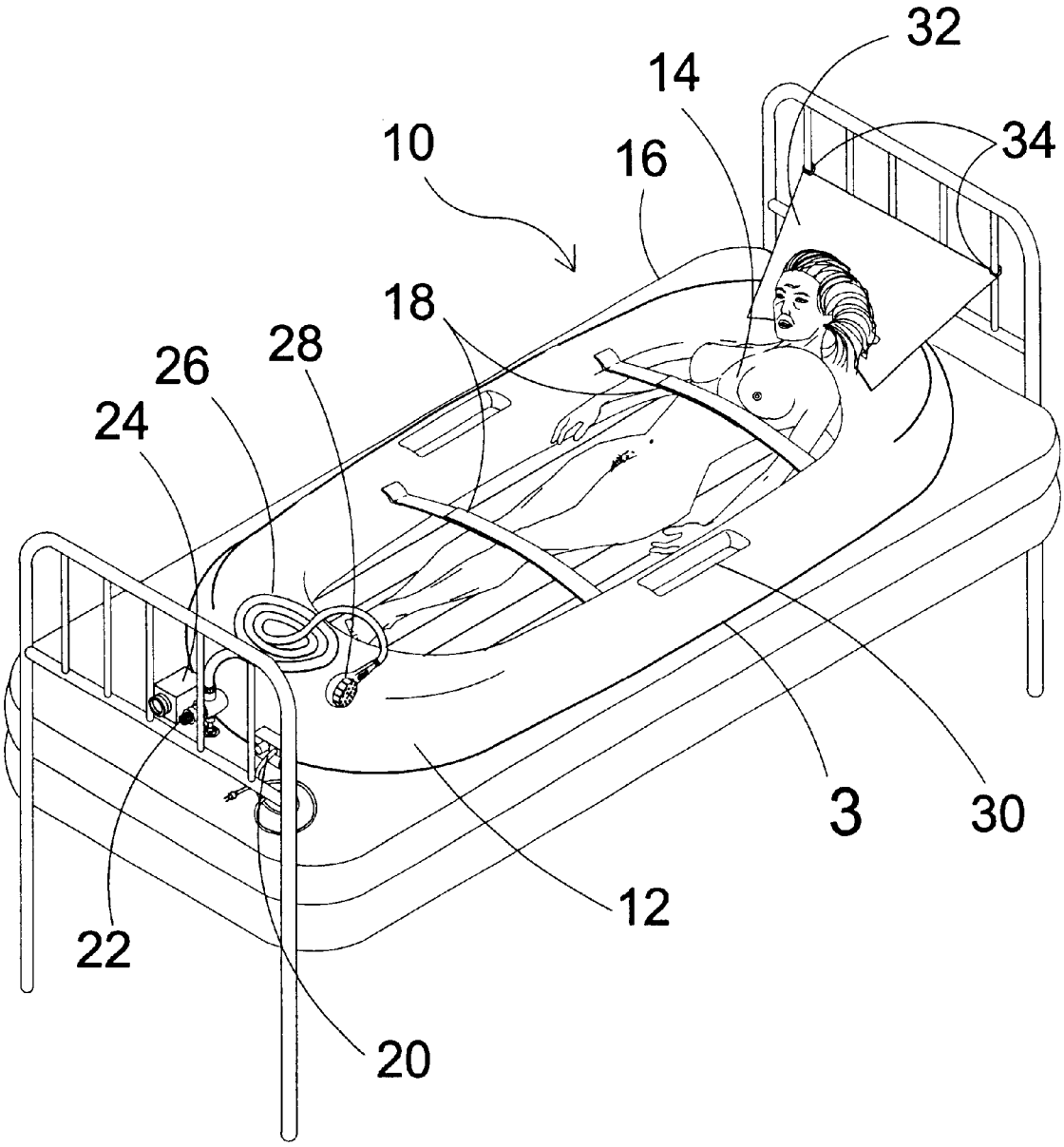
FIG. 2 is an illustrative view of the present invention in use.

Turning to FIG. 2, shown therein is an illustrative view of the present invention 10 in use. The present invention is a home and hospital health care portable bed-bath and shower device that is placed upon the conventional bed 16 of a patient 14 confined to the bed. The patient is easily placed upon the bath device prior to inflation. Multiple hook and loop straps 18 are provided to secure the patient within the bath device 12, and to lift the limbs of a patient for easy cleaning of the limbs thereof. The inflatable, oblong bathtub or housing 12 of the device is a rubber material having an electric air compressor 20, water valve 22, dirty water discharge pump 24, hose 26, shower head 28, hook and loop straps 18, a swivel head hanger (not shown, see FIG. 3), storage pockets 30 for soap and wash cloths and tote cart (not shown but see FIG. 10). A patient 14 is easily placed upon the bathtub unit 12 in a respective position prior to the inflation of the bed 12. The bath unit 12 is then inflated by the electric compressor 20 and a hose 26 is connected to the water valve 22 of the unit and at the other distal end, to a sink. A bath may now proceed. Also shown are a hair wash funnel 32 with adjustable straps 34.

Figure 3:
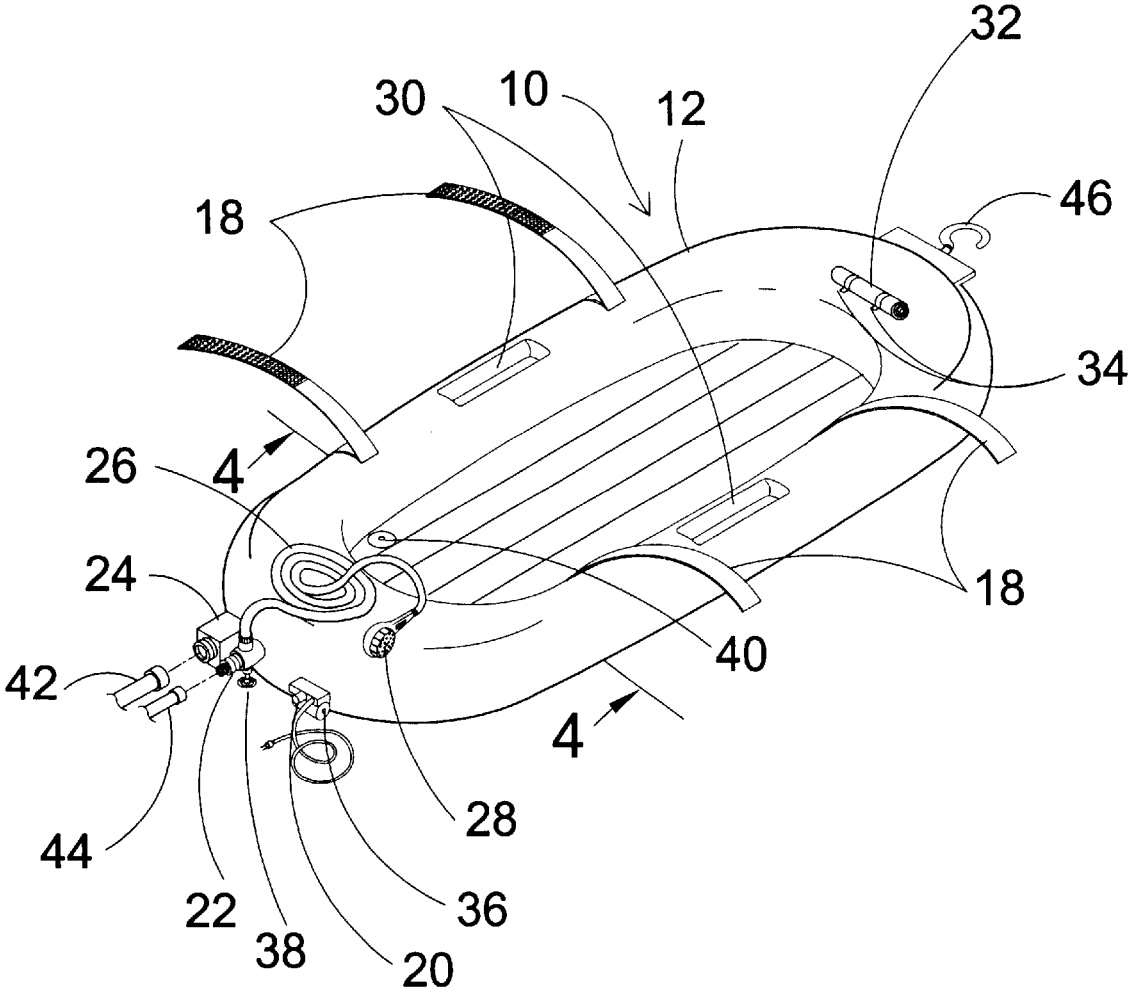
FIG. 3 is a perspective view of the present invention, fully inflated.

Turning to FIG. 3, shown therein is a perspective view of the present invention 10, fully inflated. The portable health care bed-bath 12 of the present invention provides an electric air compressor unit 20 that consists also of an air release valve 36. A water valve unit 22 is also provided, consisting of an clean water inlet hose 44, a control valve 38 and separate drain valve 40. The shower head 28 portion of the device has an on/off trigger to regulate water flow as required. Also, a dirty water discharge pump 24 and discharge hose 42 are supplied to empty used dirty water from the interior of the tub 12. Also shown is the swivel hanger 46 along with other elements previously disclosed.

Figure 4:
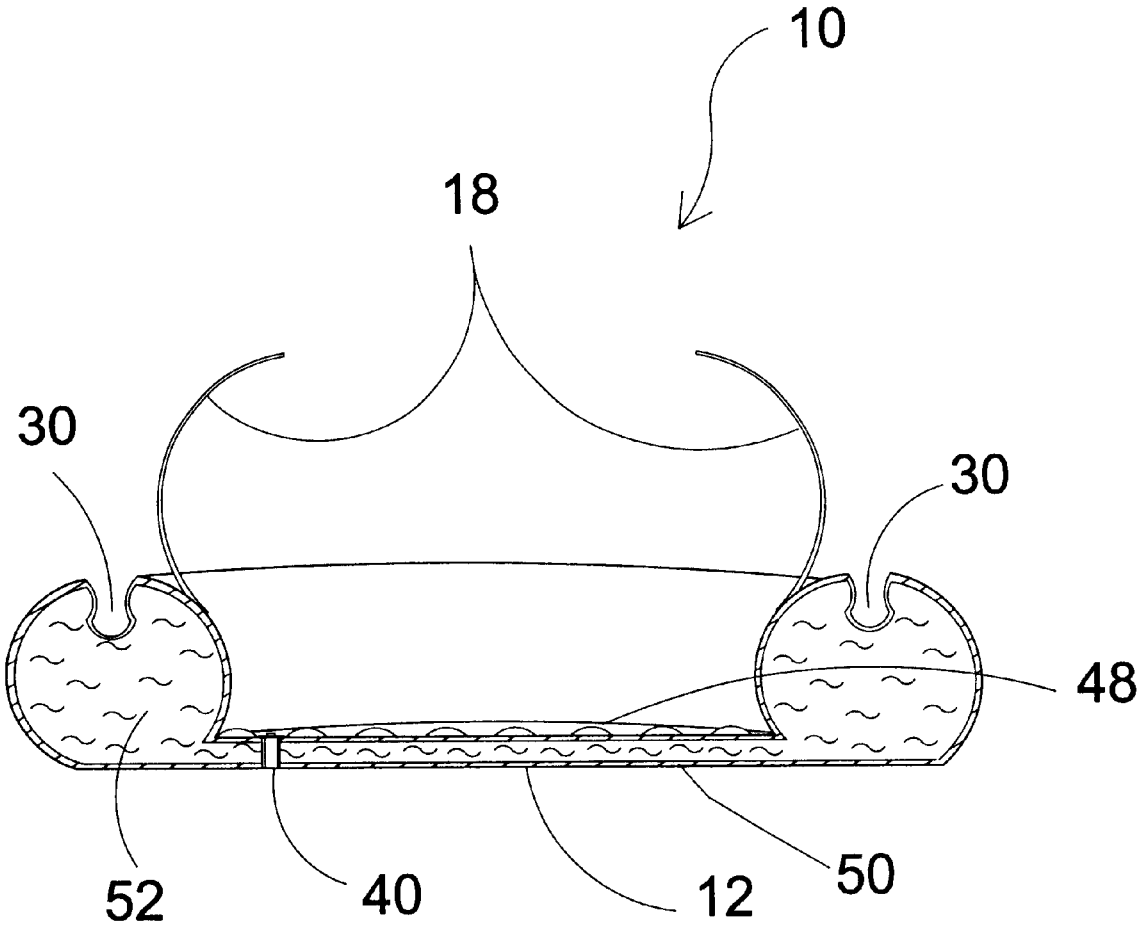
FIG. 4 is a sectional view of the present invention, fully inflated.

Turning to FIG. 4, shown therein is a sectional view of the present invention 10, fully inflated. Inflated ridges 48 located at the surface of the inner portion of the bed-bath bottom 50 aid in proper water circulation and also provide additional comfort to the patient. The air-filled cavity 52 of the bath tub is shown along with other elements previously disclosed.

Figure 5:
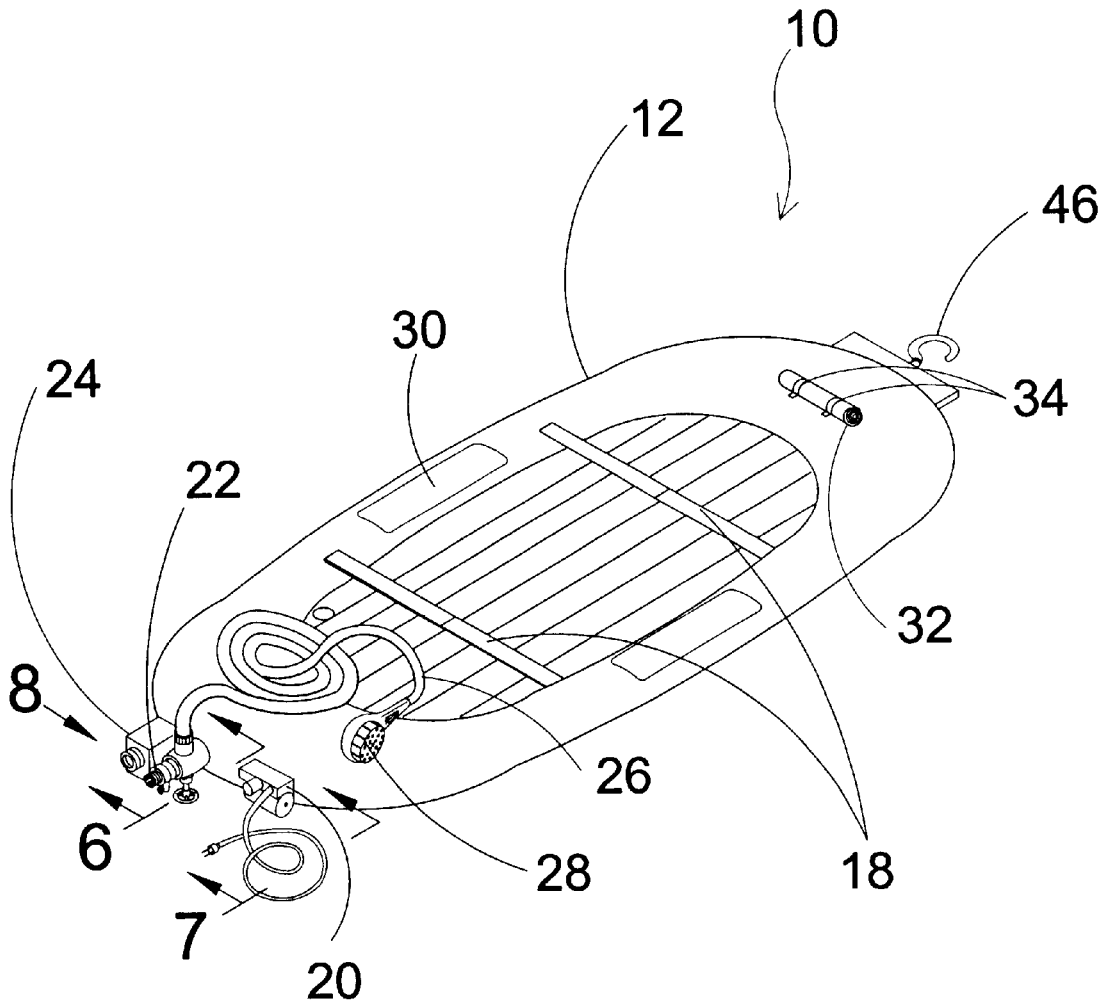
FIG. 5 is a perspective view of the present invention, deflated.

Turning to FIG. 5, shown therein is a perspective view of the present invention 10, deflated. When the bed-bath unit of the present invention is deflated and not in use, it may be stored away by hanging it from the provided hanger unit 46. This hanger 46 may also assist in the drying of the device. Other elements previously disclosed are also shown.

Figure 6:
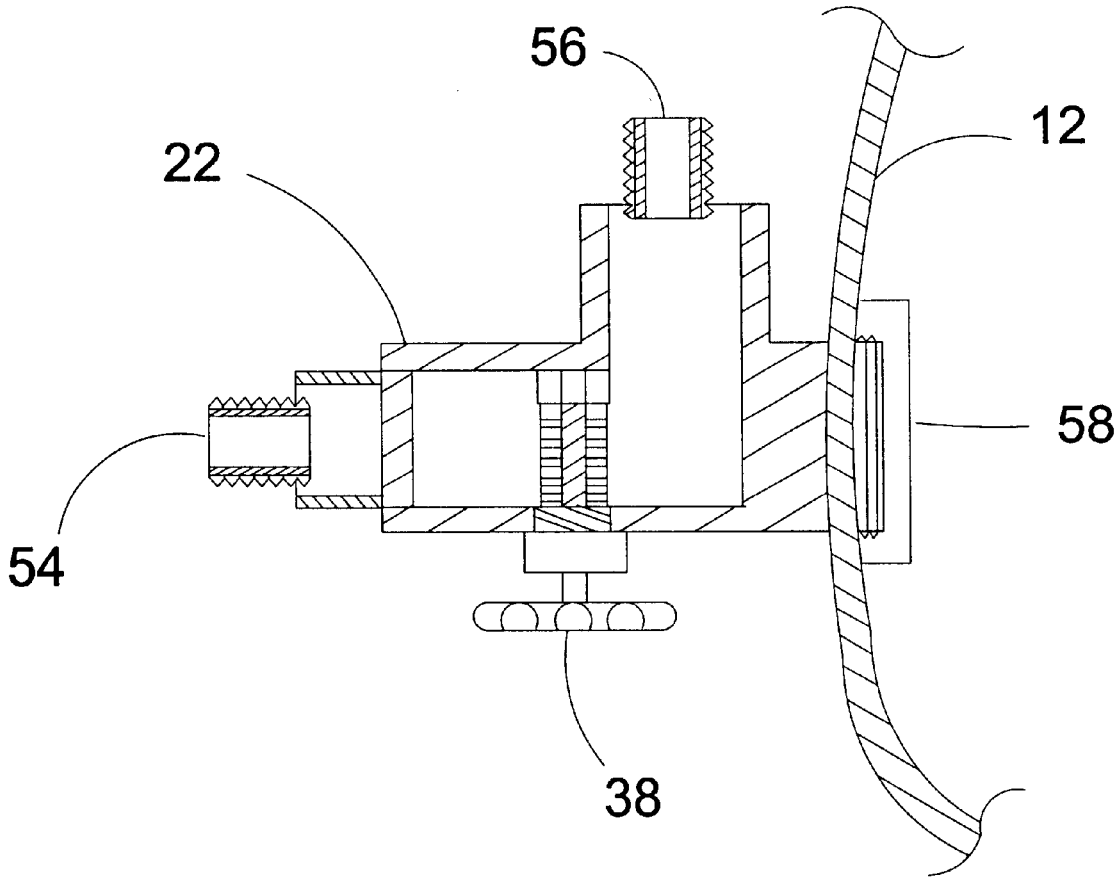
FIG. 6 is a sectional view of the water valve of the present invention.

Turning to FIG. 6, shown therein is a sectional view of the water valve 22 of the present invention. The water valve unit 22 of the present invention consists of a threaded inlet hose attachment end 54 and a threaded shower hose attachment end 56. A main control valve 38 with handle controls the entry of water to the bath unit shower head. The water valve unit is attached to the bath unit by means of a threaded securing cap 58.

Figure 7:
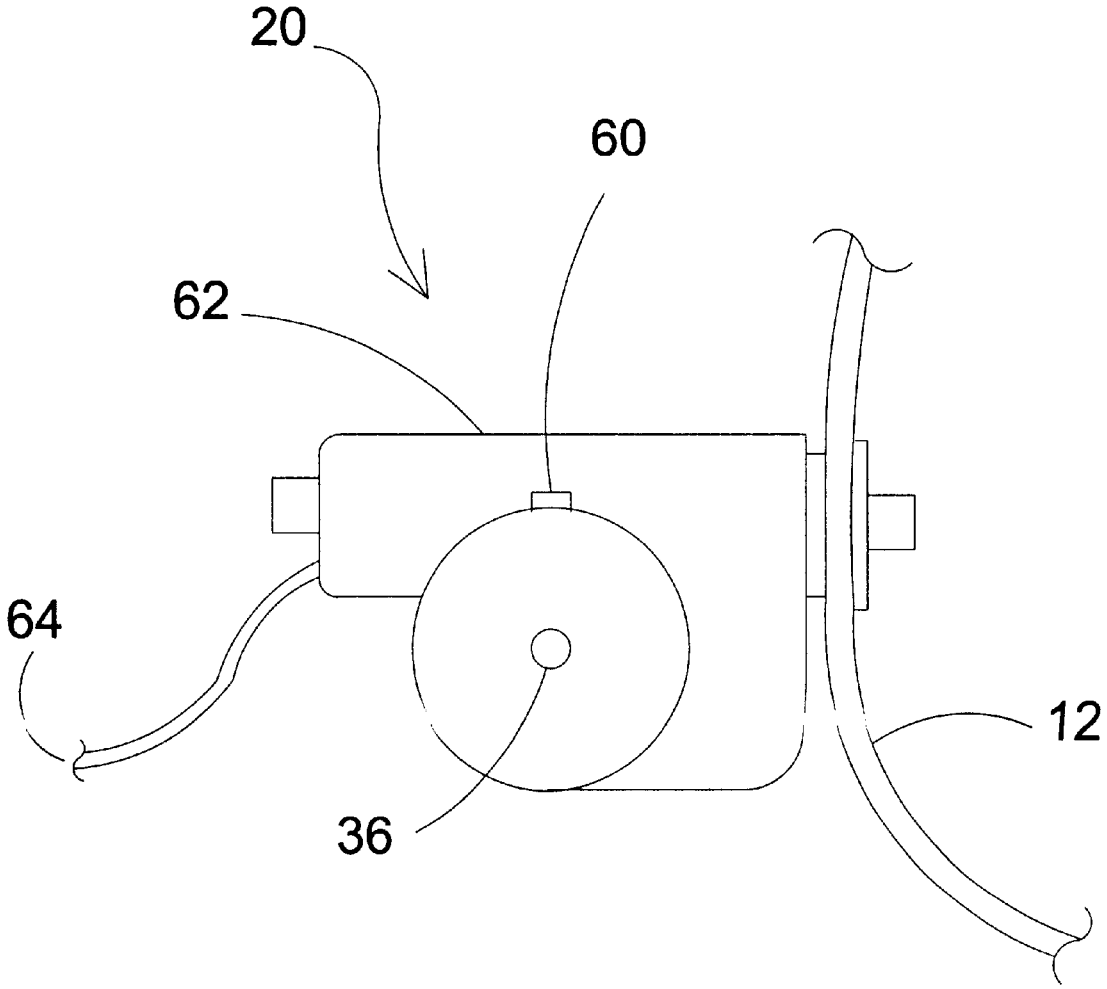
FIG. 7 is a side view of the electric air compressor of the present invention.

Turning to FIG. 7, shown therein is a side view of the electric air compressor 20 of the present invention. The electric air compressor unit 20 of the present invention allows the bathtub unit 12 to quickly fill with air to a required level or limit. The device 20 consists of an air release valve 36 operating when the air release switch 60 is activated. Also shown is the motor 62 of the air compressor with power source cord 64.

Figure 8:
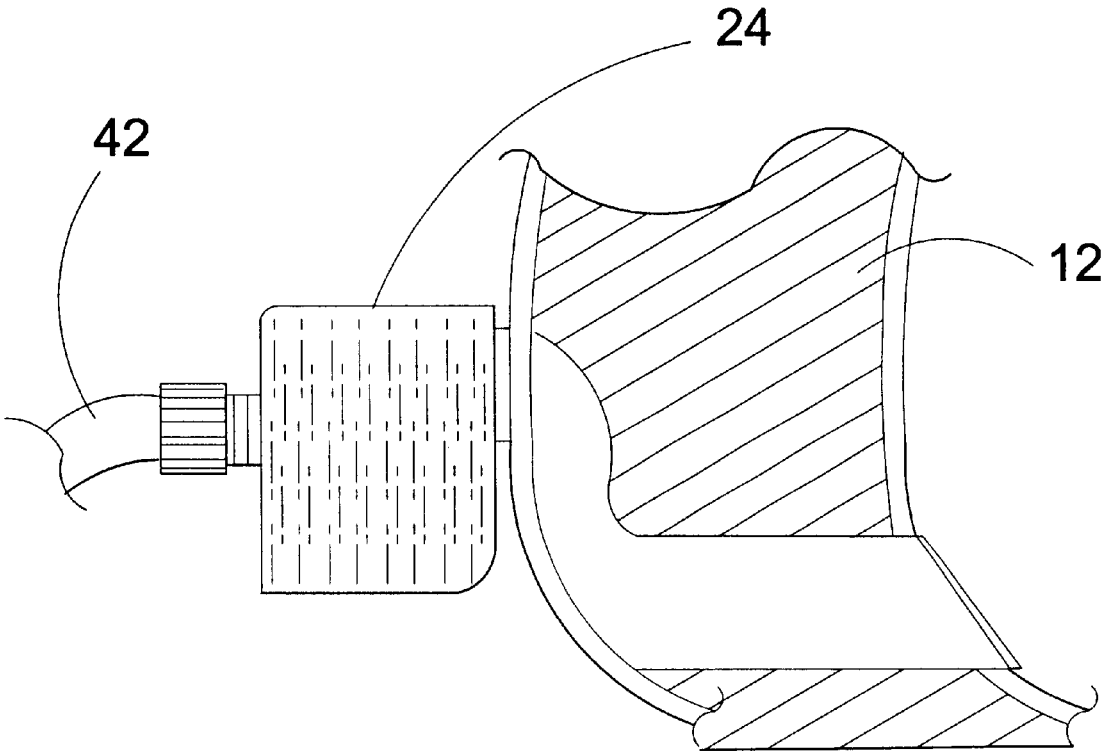
FIG. 8 is a side view of the dirty water discharge pump of the present invention.

Turning to FIG. 8, shown therein is a side view of the dirty water discharge pump 24 of the present invention. The bed-bath 12 of the present invention provides a dirty water discharge pump 24 and hose 42. The system allows for the flushing of dirty used water from the bathtub 12. Drain port 66 connects the interior of the bed bath to the discharge pump 24.

Figure 9:
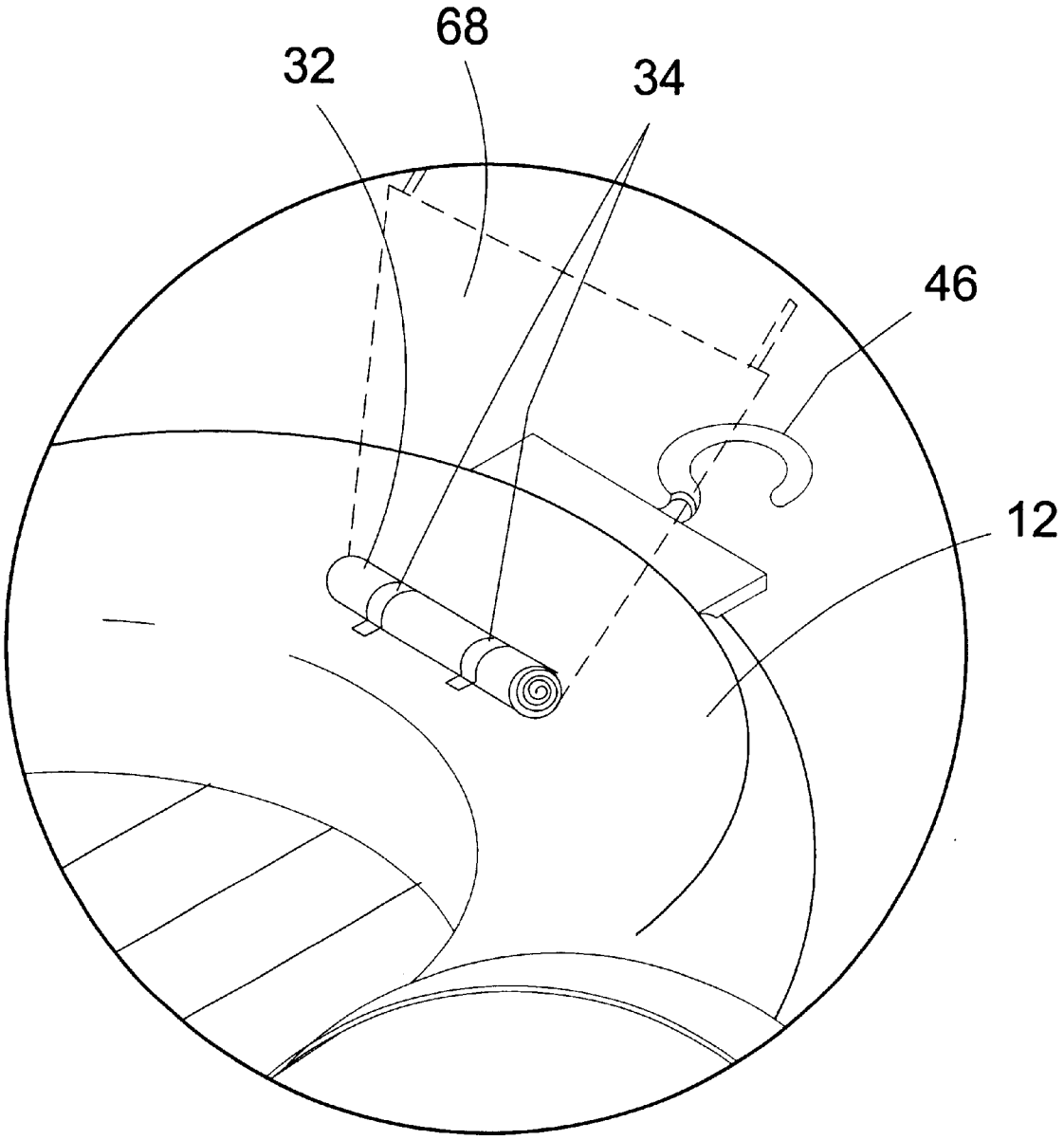
FIG. 9 is a detail view of the hair wash funnel of the present invention.

Turning to FIG. 9, shown therein is a detail view of the hair wash funnel 32 of the present invention in a secured position. A hair wash funnel 32 is provided for ease of washing and flushing used water from the patient's hair and into the bath unit. The device consists of a rubberized flap 68 containing two attachment straps 34. The funnel flap 68 can be rolled up and fastened by two hook and loop 34 strips attaching to their respective mating hook and loop counter parts being attached to the housing of the bed-bath 12. The swivel hanger 46 is also shown.

Figure 10:
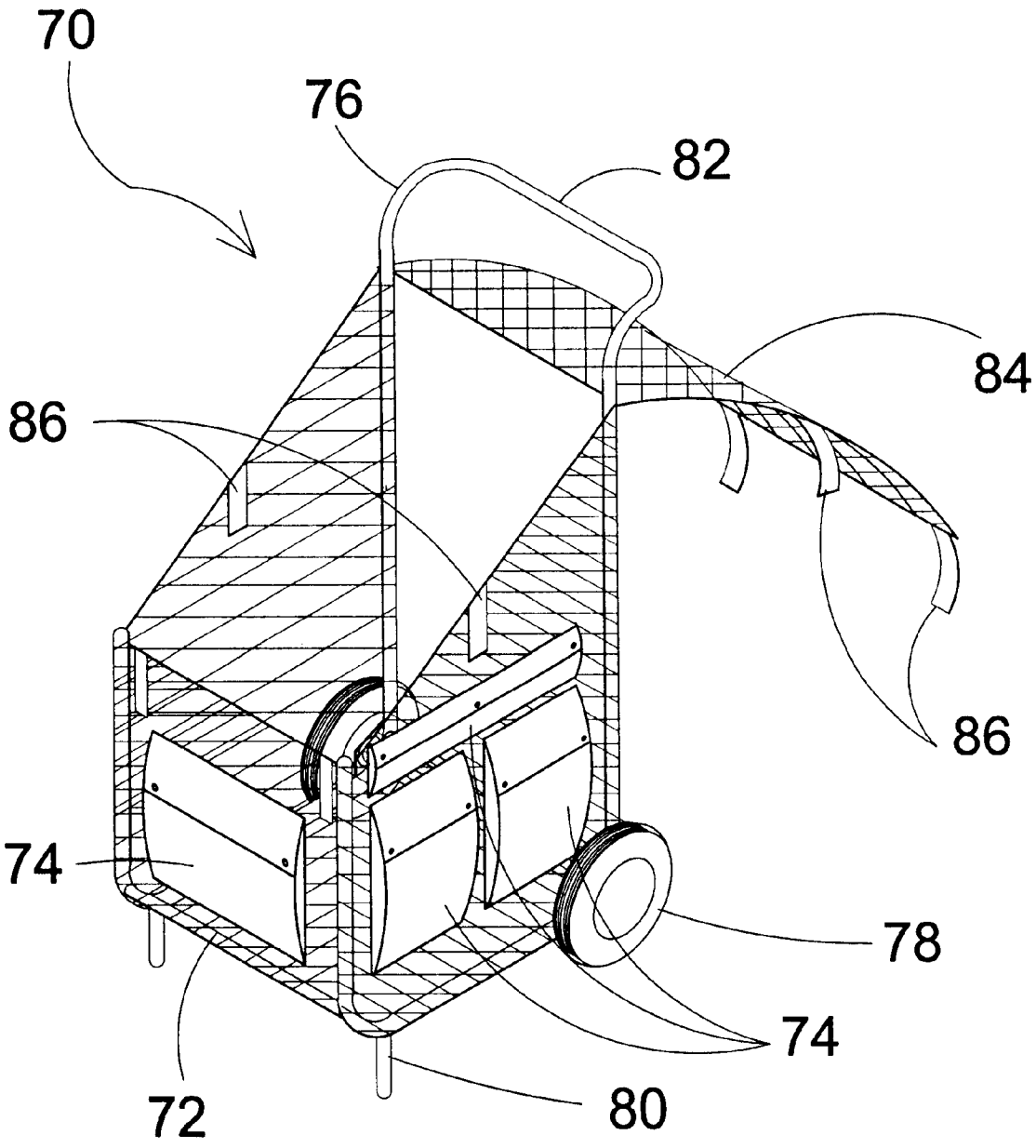
FIG. 10 is a perspective view of the tote cart of the present invention.

Turning to FIG. 10, shown therein is a perspective view of the tote cart 70 of the present invention. The bed-bath tote cart 70 of the present invention consists of a mesh bag 72 that is removable and washable, containing multiple storage bags 74 for hoses and other accessories. The frame 76 with wheels 78 and legs 80 is light weight and easy to move and store. The frame 76 has a handle 82 with mesh cover 84 held in place by hook and loop material 86.

Figure 11:
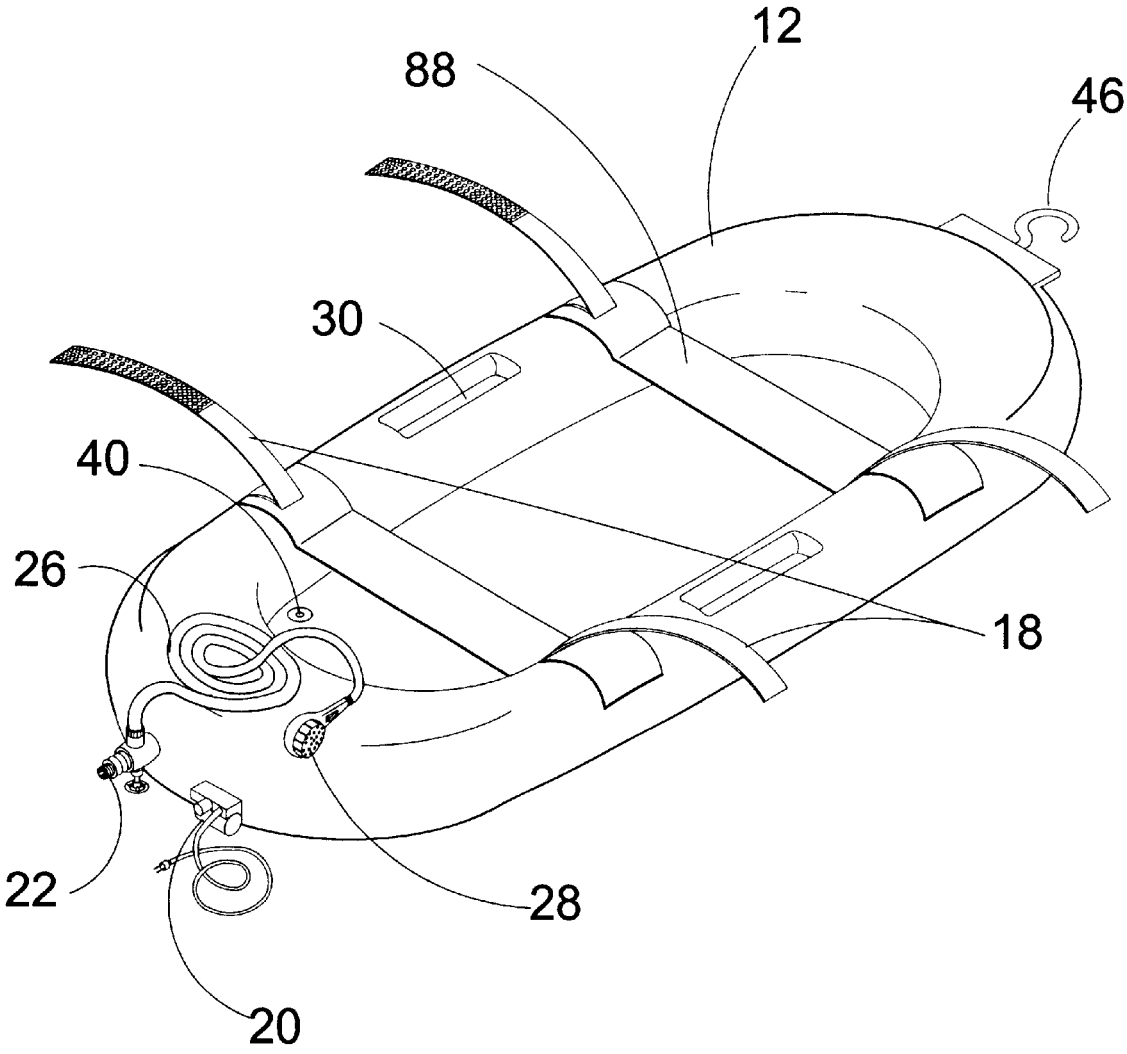
FIG. 11 is an alternate embodiment of the present invention.

Turning to FIG. 11, shown therein is an alternate embodiment of the present invention. The alternate embodiment unit of the present invention allows the body of the bather to be lifted by a body lift member being straps or the like 88 from the bottom of the bathtub unit 12 for the purpose of cleaning the under side of the body. Other elements previously disclosed are also shown.

Figure 12:
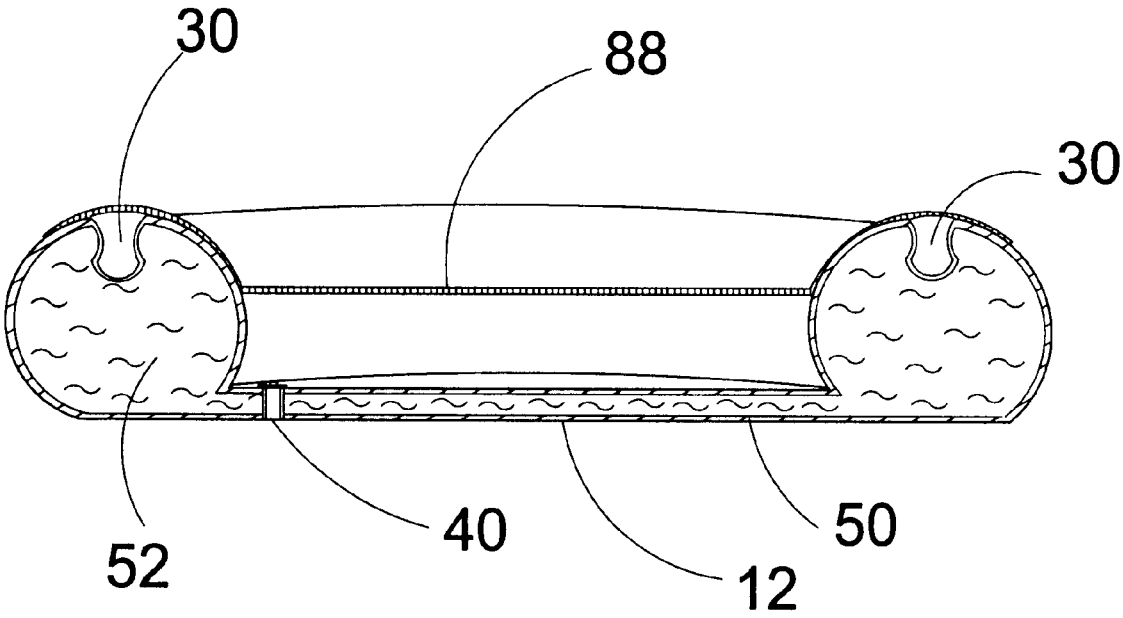
FIG. 12 is a sectional view from an alternate embodiment of the present invention.

Turning to FIG. 12, shown therein is a sectional view from an alternate embodiment of the present invention. The body lift member 88 being an alternate embodiment of the present invention allows the body of the bather to be lifted from the bottom 50 of the bathtub unit 12 for the purpose of cleaning the under side of the body. Other elements previously disclosed are also shown.

What is claimed to be new and desired to be protected by Letters Patent is set forth in the appended claims.

I claim:

1. An apparatus for an inflatable portable bath and/or shower for placement upon a conventional bed for use by a patient, comprising:

a) an oblong bath tub unit, said unit being sized to receive the patient therein, said unit being complementarily sized as the bed, said unit having a head end, a foot end, and a bottom having an upper inner side and a lower outer side;

b) means for inflating said bath tub unit whereby the air pressure in said unit can be controlled;

c) means for supplying water to said bath tub unit whereby clean water can be input into said unit for use by the patient;

d) means for discharging water from said bath tub unit whereby dirty water can be removed from said unit;

e) means for securing the patient within said bath tub unit whereby the patient is safe internal said unit;

f) said bath tub unit having an enlarged inflatable outer portion wherein said outer portion forms an outer wall surrounding said bottom for containing water therein, said bath tub unit further comprises inflated ridges disposed on said upper inner side of said bottom for increasing the comfort of the patient, and storage pockets disposed on said enlarged outer portion of said bath tub unit;

g) said means for inflating said bath tub unit further comprising an air compressor motor disposed on said bath tub unit wherein said air compressor motor is electrically powered, wherein said air compressor motor has means for attachment to said bath tub unit whereby said air compressor motor attaches to and inflates said bath tub unit;

h) said means for supplying water to said bath tub unit further comprises a water valve disposed on said bath tub unit, said water valve having a water inlet and a water outlet, wherein said water valve has means for attachment to said bath tub unit whereby said water valve attaches to and supplies water to said bath tub unit;

i) said water valve further comprising a control valve disposed thereon, a handle disposed on said control valve for use by a user for controlling the flow of water through said water valve;

j) a shower hose, said shower hose having a first end and a second end, said first end for connection to said water outlet of said water valve, a shower head disposed on said second end of said shower hose, said shower head further comprising an on/off switch disposed thereon;

k) said means for discharging water from said bath tub unit further comprising a discharge pump disposed on said bath tub unit, said discharge pump having a water inlet and a water outlet, said water inlet comprising means for connection to said bath tub unit whereby dirty water can be removed therefrom;

l) a clean water supply hose and a dirty water discharge hose, said clean water supply hose being connected to said water inlet of said water valve, and said dirty water discharge hose being connected to said water outlet of said discharge pump;

m) said means for securing the patient within said bath tub unit further comprising a pair of straps oppositely disposed on said outer wall of said bath tub unit, each pair of straps having a first end and a second end, wherein said first and second ends of each strap have means of connection to each other;

n) said means of connection of said first and second ends of said straps further comprising mating hook and loop material;

o) a hair wash funnel disposed on said head of said bath tub unit whereby the patient's head can be washed and the wash water will flow back into said bath tub unit;

p) said hair wash funnel further comprising a flap, wherein said flap has means for connection to the bed of the patient; and q) said means for connection of said flap to the bed further comprising a pair of straps disposed on an edge of said flap, said straps for being tied to the bed of the patient when said flap is extended and for securing said flap in a rolled up position.

2. The apparatus of claim 1, further comprising a hook for hanging said bath tub unit, said hook being swiveable, said hook being disposed on said head end of said bath tub unit.

3. The apparatus of claim 2, further comprising a body lift device disposed on said bath tub unit whereby the patient can be lifted off of said bottom of said bath tub unit.

4. The apparatus of claim 3, wherein said body lift further comprises a pair of straps for placement under the patient.

5. The apparatus of claim 4, further comprising a drain valve disposed in said bottom of said bath tub unit for draining water therefrom.

6. The apparatus of claim 5, further comprising a movable cart whereby said bath tub unit can be stored in the cart and moved about in the cart.

7. The apparatus of claim 6, wherein said movable cart further comprises a cart, said cart having a frame, said frame having four side walls, a top, and a bottom, wherein said walls, said top and said bottom comprises a mesh material, further comprising a plurality of wheels disposed on said bottom of said frame for rolling said cart about, further comprising a plurality of pockets disposed on said walls of said cart for storing objects, wherein said top is fastened to said cart by using hook and loop.

* * * * *